United States Patent [19]

Apperley et al.

[11] Patent Number: 4,566,005

[45] Date of Patent: Jan. 21, 1986

[54] DATA MANAGEMENT FOR PLASMA DISPLAY

[75] Inventors: Norman Apperley, Chandlers Ford, United Kingdom; Roger J. Edwards, Woodstock, N.Y.; Raymond L. J. Foster, Landford, United Kingdom; David C. Haigh, Winchester, United Kingdom; Michael Haslam, Winchester, United Kingdom; Peter Verey, Winchester, United Kingdom

[73] Assignee: International Business Machines Corporation, Armonk, N.Y.

[21] Appl. No.: 472,776

[22] Filed: Mar. 7, 1983

[51] Int. Cl.[4] ..... G09G 3/28

[52] U.S. Cl. ..... 340/771; 340/794; 340/803

[58] Field of Search ..... 340/771, 794, 803, 811, 340/813, 731, 723, 726, 709, 708

[56] References Cited

U.S. PATENT DOCUMENTS

| | | | |
|---|---|---|---|
| 3,993,990 | 11/1976 | Miller et al. | 340/771 X |
| 4,087,806 | 5/1978 | Miller | 340/771 |
| 4,101,810 | 7/1978 | Schermerhorn et al. | 340/813 X |
| 4,143,360 | 3/1979 | Bernhart et al. | 340/711 |
| 4,201,983 | 5/1980 | Magerl et al. | 340/709 |
| 4,247,856 | 1/1981 | Fumeron | 340/771 |
| 4,368,463 | 1/1983 | Quilliam | 340/744 |
| 4,394,735 | 7/1983 | Satoh et al. | 364/200 |
| 4,430,649 | 2/1984 | Leininger | 340/723 X |

*Primary Examiner*—John W. Caldwell, Sr.
*Assistant Examiner*—Vincent P. Kovalick
*Attorney, Agent, or Firm*—C. Lamont Whitham; Frederick D. Poag

[57] ABSTRACT

A display management system for one or more large plasma gas panel displays (11) is organized to split the display management operations between a host processor (20), a system microprocessor (21) and a picoprocessor (27). The picoprocessor (27) is the heart of a common internal bus (31) plasma display adapter (22). The program for the display is downloaded from the host processor (20) to the system microprocessor (21). The microprocessor generates op codes and initializes display parameters. The plasma display adapter provides control for the plasma panel interface, serialization of character generator data, translates display position addresses for absolute cartesian coordinates to panel address, and computes the boundaries of display panel write and erase operations. Interaction between the system microprocessor and the plasma display adapter is minimized by a code list contained in the microprocessor memory and fetched by direct memory access. This code list contains high level commands which the picoprocessor in the adapter decodes and translates into simple commands for the surrounding interface logic.

9 Claims, 21 Drawing Figures

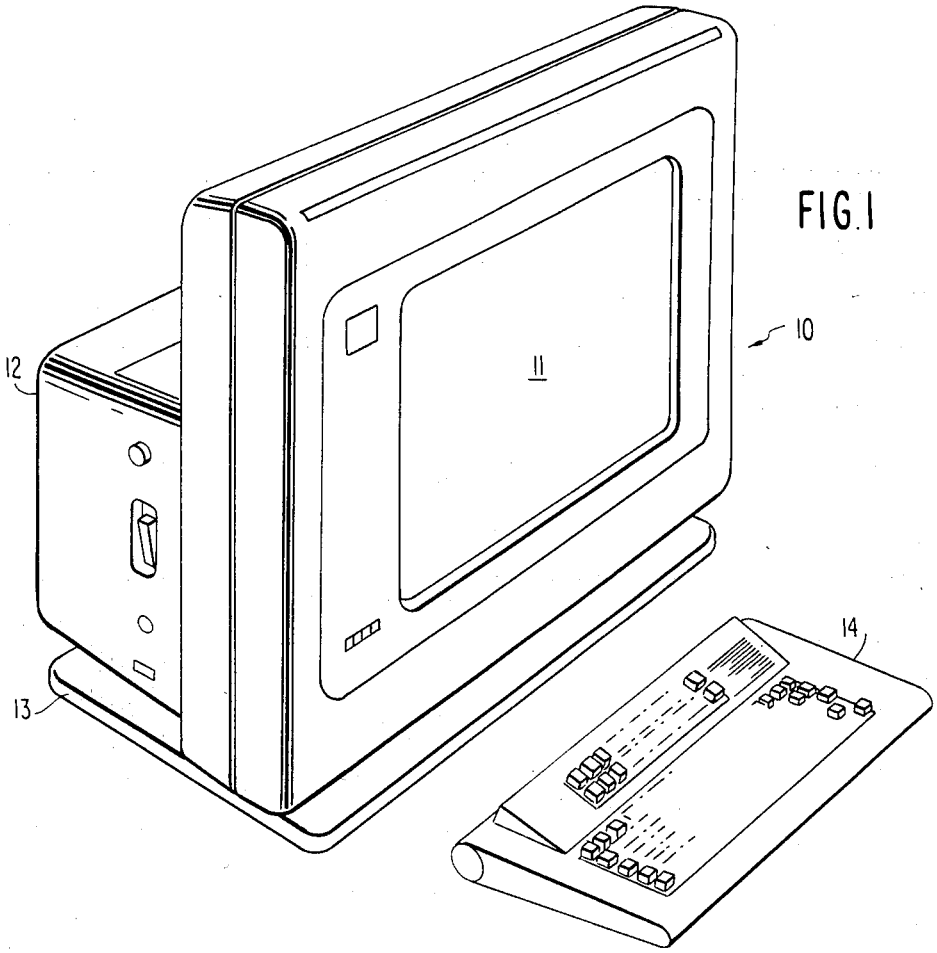
FIG. 1
FIG. 2
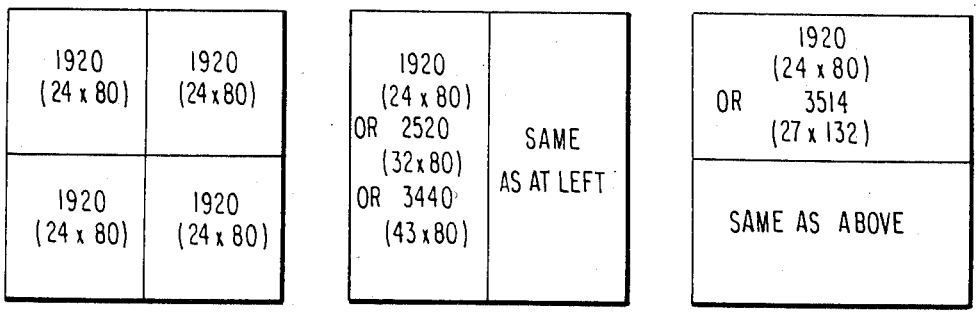

HORIZONTAL Y DRIVER MODULE

DON'T CARE

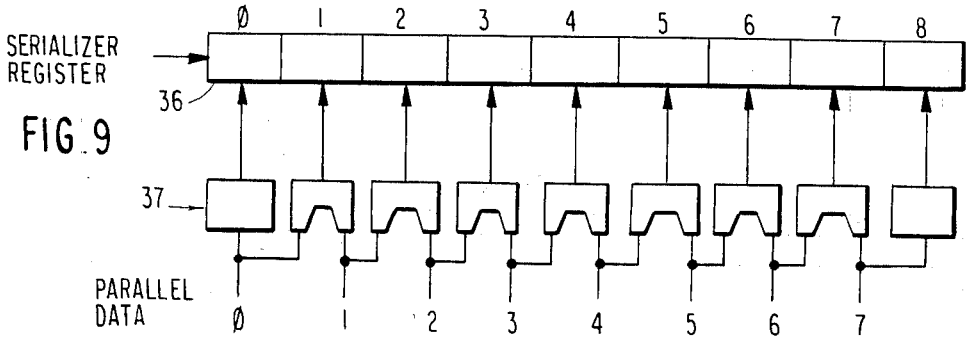
FIG. 9
FIG. 10
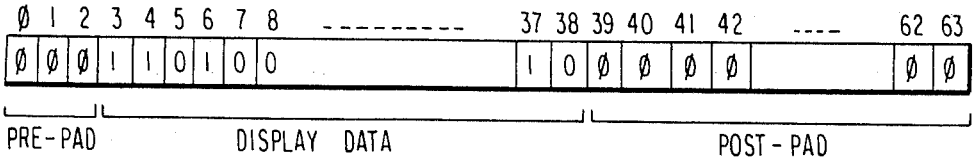
FIG. 11
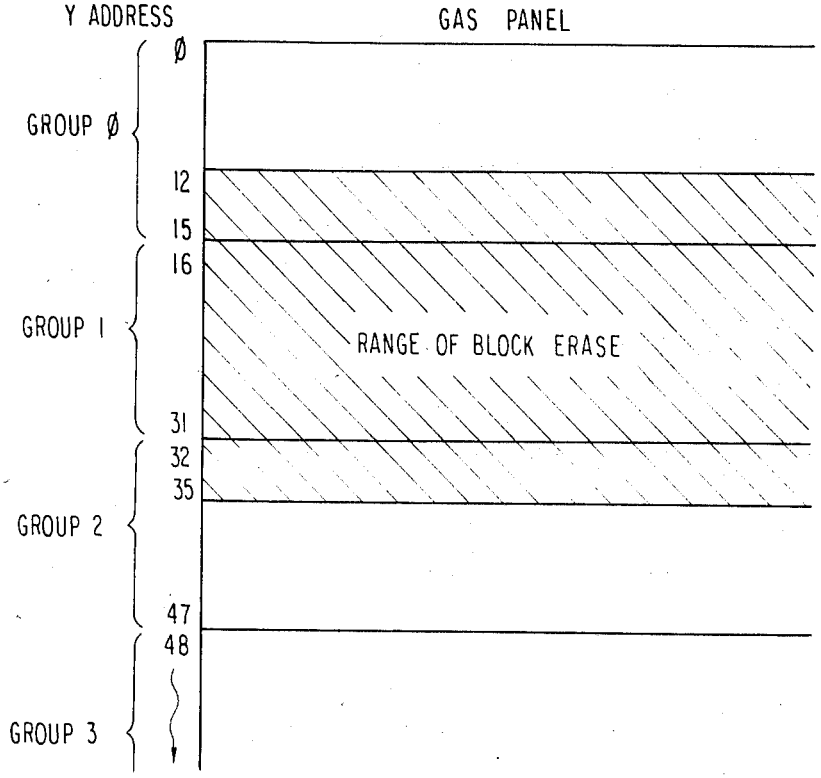

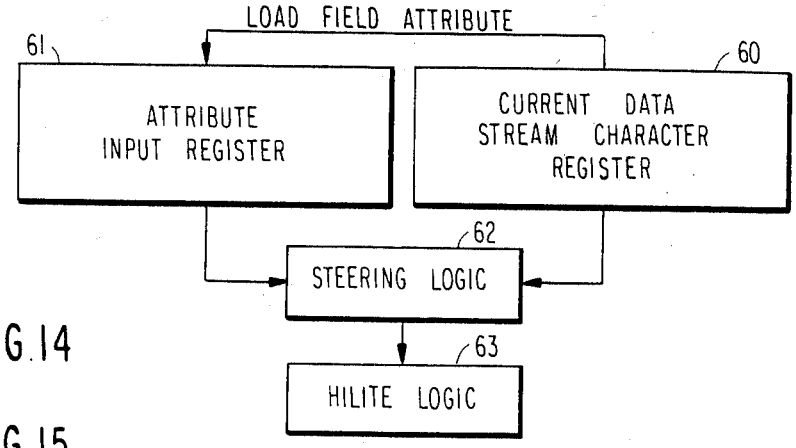
FIG.14
FIG.15
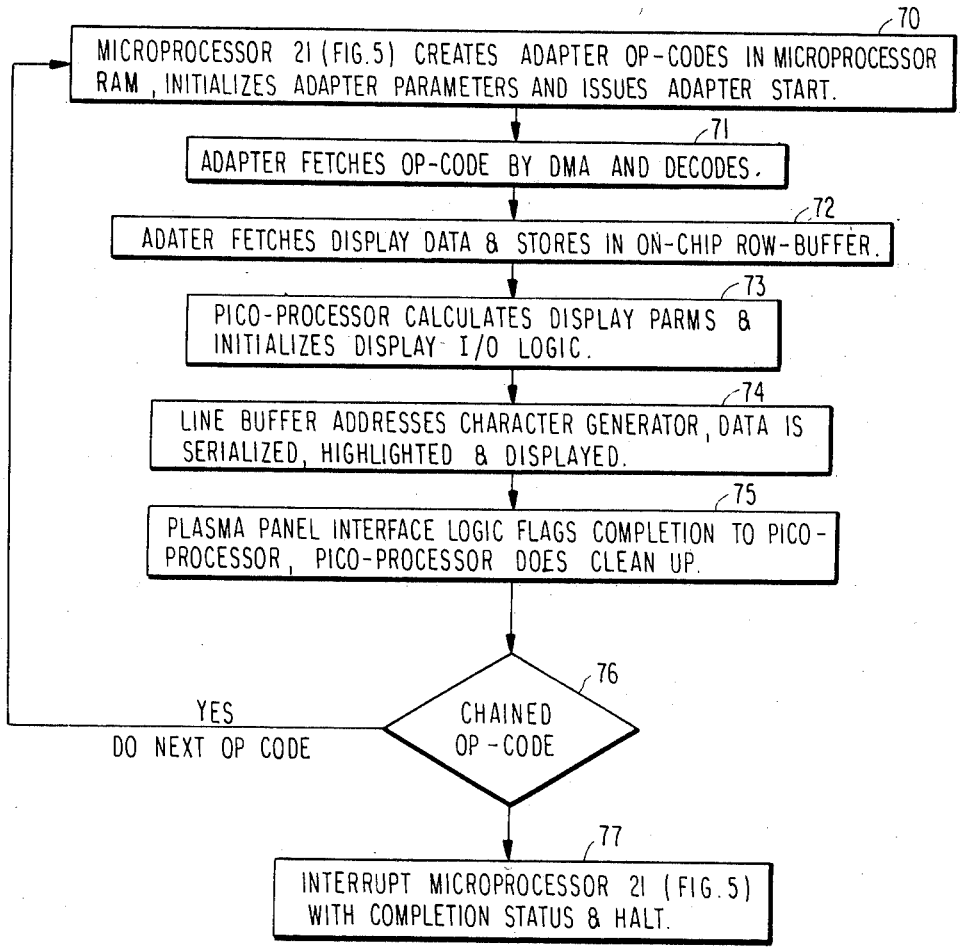

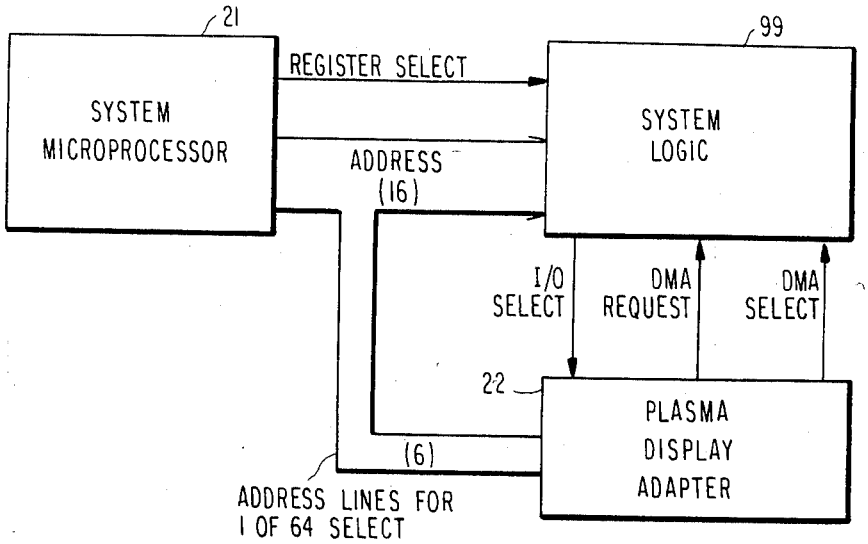
FIG. 16
FIG. 17
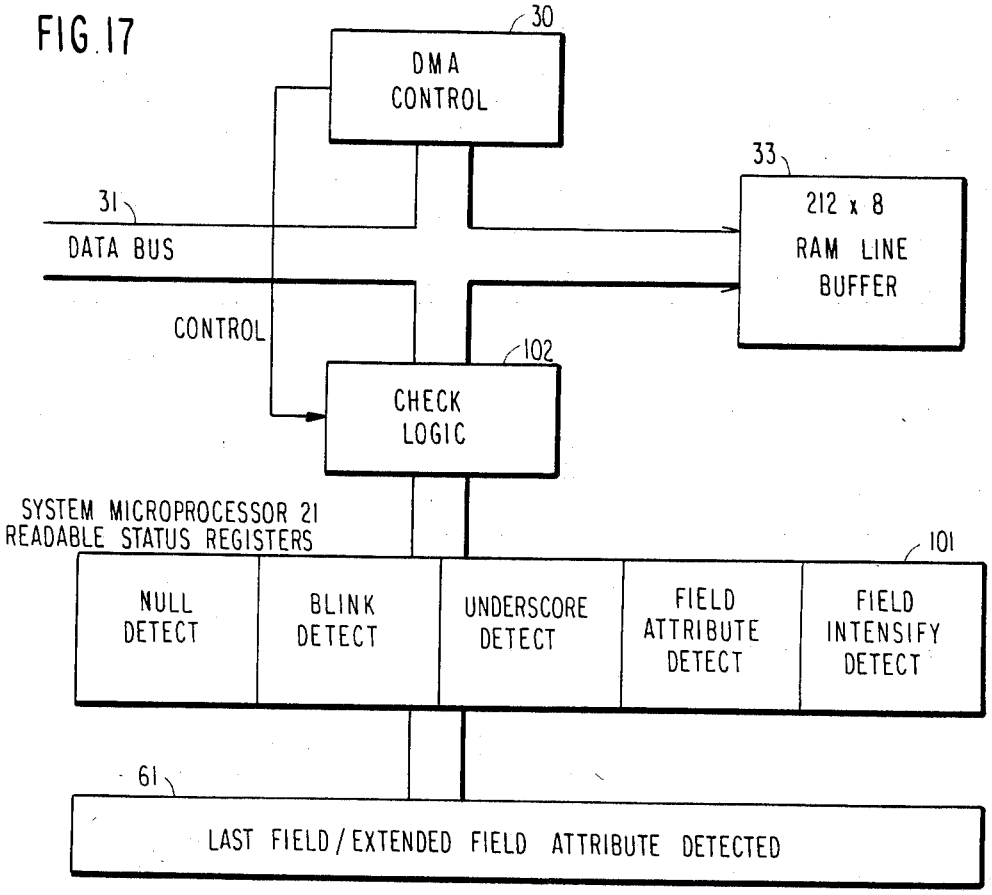

DATA MANAGEMENT FOR PLASMA DISPLAY

BACKGROUND OF THE INVENTION

This invention generally relates to displays for computer and data processing terminals, and more particularly to the electronic data management for a large plasma gas panel display.

The predominant display technology has been the cathode-ray tube (CRT). When flat panel matrix display technologies made their debut, it was expected that this compact-type device would revolutionize the packaging and appearance of display terminals, but this has happened only to a limited extent. There are several matrix-addressed display technologies presently in use: liquid crystals, light-emitting diodes, vacuum fluorescents, a.c. and d.c. plasmas and to a lesser degree a.c. and d.c. electroluminescents. The subject invention is directed to a.c. plasma display technology that provides a large screen, multiple image-format capability. The use of higher information content displays is advantageous for applications requiring the scanning of multiple pages of reference material and for cross-referencing multiple pages or frames of stored information.

The a.c. plasma display technology is a memory technology. Because of this characteristic of the technology, the maximum size, or maximum information content of the screen, is not limited by the device's luminance-voltage characteristic as is the case for refresh display devices, but is limited only by manufacturability considerations. The specific display used is a gas panel having a plurality of horizontal and vertical wires divided into odd and even groups which are physically addressable from opposite edges of the panel. This arrangement allows closer spacing of the wires and the electronic components that generate the driving voltages for the individual wires. The gas panel is an all points addressable device in which the display cells, located between the orthogonal conductor arrays, are individually and selectively addressable. An example of this technology is disclosed in U.S. Pat. No. 4,200,868 issued to Lamoureux et al and assigned to the assignee of the subject invention. A specific example of a gas panel which may be used with the present invention is the model 581 Plasma Display Subassembly available to original equipment manufacturers (OEMs) from the International Business Machines Corporation.

SUMMARY OF THE INVENTION

It is an object of the present invention to provide a data management system that permits full utilization of the advantages of the large screen display afforded by a plasma gas panel.

It is a more specific object of the invention to provide a plasma display adapter which can provide full screen or simultaneous multiple screen displays on the same gas panel thereby permitting display of multiple copies or multiple independent data processing sessions.

These and other objects of the invention are accomplished by providing a plasma display adapter that controls the gas panel, a keyboard and other I/O units and a programmable character generator. The plasma display adapter is designed around a common internal bus and contains a plurality of logic "macro"s, a read-write random access memory (RAM) and a read only storage (ROS). The plasma display adapter in the subject invention implements these logic macros with programmable logic arrays (PLAs). The plasma display adapter interfaces with a display system microprocessor having its own associated RAM. The program for the display is downloaded from a local control unit (which is attached to a host system) to the microprocessor memory. System logic, driven by the microprocessor and the adapter, generates all memory addresses and control signals for accessing of memory by the processor during execution of code and by the adapter for transferring data to and from memory. The plasma display adapter has a register mapped I/O control and a picoprocessor which controls data flow to and from a row buffer, the gas panel, and the character generator. Operation of the display is thus split between the host, microprocessor and picoprocessor. The host provides application program operations and downloads programmed symbols. The microprocessor carries out decoding and execution of commands including management of the display data. The plasma display adapter provides control for the plasma panel interface, serialization of both character generator and non-coded data, translates display position addresses from absolute cartesian coordinates to panel address, and computes the boundaries of display panel write and erase operations.

Because the display panel is all points addressable and has inherent storage characteristics, updating of the display and partitioning of the display are rather unique when compared to the same functions performed as a conventional CRT display. In the subject invention, these functions are performed primarily by the plasma display adapter picoprocessor. Since the gas panel cannot generally be updated as quickly as data is changing, unnecessary updates are eliminated by the microprocessor by associating with each row of data in the display buffer an update list containing flags indicating which rows have changed. The replace mode can be used to update characters for insert, delete or scrolling operations. In this mode, all pels within the boundary of the new character are first erased and then selected pels are written based on the chosen character. The microprocessor does not have to know the screen contents in an update area or specify the erasure of an individual pel. The adapter can write or erase a horizontal stripe the width of the gas panel screen and, in the specific embodiment disclosed, up to sixteen pels high. Thus, for a sixteen pel high character, only one or two erase cycles are used, providing improved performance. The adapter further allows the screen to be partitioned to provide multiple viewing windows, with previously generated data displayed in one window adjacent to updated data in another window or, alternatively, with the simultaneous display of a plurality of data processing sessions on a single screen.

Interaction between the microprocessor and the plasma display adapter is minimized by a code list contained in the microprocessor memory and fetched by direct memory access (DMA). This list consists of high level commands, and while each code is limited to one type of operation, single codes can be linked in the microprocessor memory to provide macro results. The picoprocessor in the adapter decodes these high-level commands and translates them into a sequence of simple commands for the surrounding interface logic.

BRIEF DESCRIPTION OF THE DRAWINGS

The specific nature of the invention, as well as other objects, aspects, uses and advantages thereof, will clearly appear from the following description and from the accompanying drawings, in which:

FIG. 1 is a perspective view of a display terminal and keyboard;

FIG. 2 illustrates some of the possible partitionings of the screen display;

FIG. 9 is a block end logic diagram illustrating the operation of the serializer register in the plasma display adapter;

FIG. 10 illustrates the manner in which horizontal alignment of displayed data is attained;

FIG. 11 is another diagramatic representation of the gas panel showing the process of block erasure;

FIG. 14 is a block diagram of the use of registers in the plasma display adapter to insert and detect attributes;

FIG. 15 is a flow diagram of the operation of the high level interface provided by the plasma display adapter according to the invention;

FIG. 16 is a block diagram illustrating the addressing of one of sixty-four registers within a plasma display adapter which may be connected to a single system microprocessor; and FIG. 17 is a block diagram illustrating attribute testing in the plasma display adapter.

DESCRIPTION OF A PREFERRED EMBODIMENT

Figure 3:
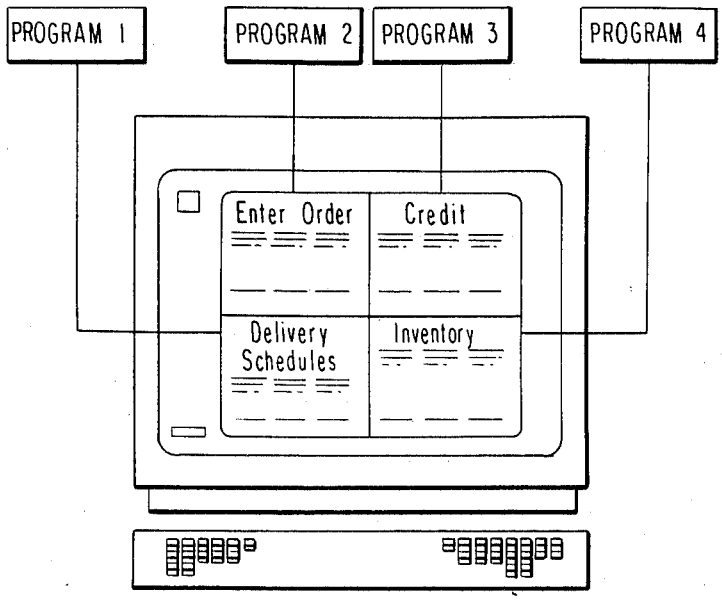
FIG. 3 shows a specific application where displays are presented in each of four quadrants of the screen.

Referring now to the drawings and more particularly to FIG. 1, the plasma gas panel display is housed in a cabinet 10 that takes advantage of the inherent two dimensional structure of the gas panel 11. Basically, the cabinet 10 has the appearance of a framed panel of modest thickness with a smaller rectangular housing 12 in the back for some of the electronics and power supply. Advantageously, the framed panel may be mounted on a base 13 with the mounting being pivotal in a horizontal axis to permit tilting of the display. A separate keyboard 14 is provided and is typically connected to the display electronics by a cable (not shown).

The most common display applications today are written for 1920 (24×80) character displays typical of CRT displays. The high-capacity a.c. plasma display used in a preferred application of the subject invention is capable of displaying 9920 characters. To obtain immediate benefits from a high-capacity display of this type, existing applications must be capable of being adapted to the display. Two features have been developed to achieve this objective. They are the display multiple copy screens and display multiple interactive screens. A third feature, multiple partitions, has been developed to allow modified and newly written applications to make full use of the capabilities of the high-capacity plasma panel display. By using a character cell size of 6×12 pels, it is possible to accomodate 1920 characters in one quadrant of the plasma panel, in the standard format of 24 rows of 80 characters. This provides the possibility of displaying as many as four 1920 character "screens" of information simultaneously. Similarly, it is possible to display two "screens" of other standard sizes either side by side or one above the other. Horizontal and/or vertical divider lines one pel in width are written to differentiate the "screens" displayed. FIG. 2 illustrates these possibilities.

In the multiple copy screen feature, the user can make copies of one area or "screen" of the display in another without making any modifications to his software. The display is divided into four quadrants with the top left quadrant, for example, being designated as the "active area". This is the only area that the host software is aware of and appears, for example, as a 1920 character display to the host. The remaining areas are used as reference areas. The user can copy the entire display within the active area to any one of the reference areas, and the user may also clear any chosen reference area.

In the multiple interactive screen feature, the user can run several applications simultaneously. This feature is illustrated in FIG. 3. The display is again divided in up to four quadrants, but each of the areas of the plasma panel is an active area. Each area defines a logical terminal and has a different device address. To the host, the plasma display terminal appears to be up to four separate display terminals; thus, the only impact to the host software is to modify tables of device addresses and characteristics. The host may interact with any of the active areas by addressing a data stream to it.

The multiple partitions feature allows a host application to divide the plasma display panel into a collection of up to sixteen nonoverlapping rectangular areas. Certain characteristics may then be defined for each of these areas, such as character size, the format of the data streams returned to the host, its position on the display, and whether it is "scrollable".

Figure 4:
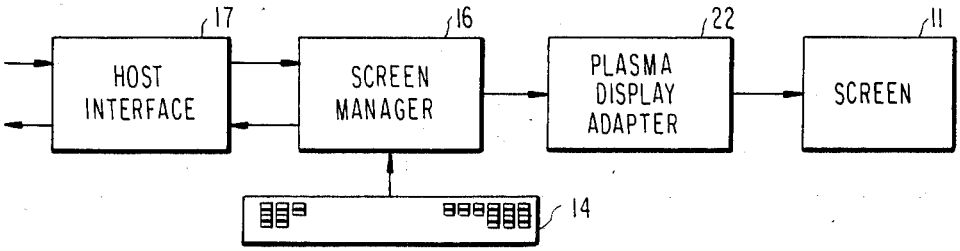
FIG. 4 is a block diagram showing the relationship of the keyboard controlled Screen Manager to the host and the plasma display adapter of the subject invention.

The subject invention follows the design philosophy of system network architecture (SNA). SNA freed mainframes and connecting lines from device dependence so that a common physical link could service multiple applications and multiple device types. SNA defines architectural relationships between logical entities instead of physical devices. This creates an opportunity for product developers to combine multiple logical entities into a single physical device, which in the case of the subject invention is realized with the multiple screen partitioning and multiple data base access just described. The gas panel technology is important to the multiple terminal-multiple data base concept for three reasons. First of all, the fine resolution of the gas panel display allows an unusually high number of characters (in the specific example given, 9920 characters) to appear on the screen at the same time. Secondly, gas panel technology is flicker-free and permits storage of data on the screen in a way that CRT technology has not yet allowed. Finally, all this can be done in an ergonomically enhanced package that fits easily into a user's work environment. Matching the plasma gas panel with SNA capabilities is achieved by means of a screen manager 16 as shown in FIG. 4. The screen manager 16 communicates with the host interface 17 and controls the display on screen 11 through the plasma display adapter 22. The screen manager 16 allows user control via the keyboard 14 of the functions available from the host. It is the screen manager that allows the user to choose and rearrange screen formats.

The plasma gas display panel driven by the adapter according to the present invention has a more complex interface than earlier plasma gas panel displays. The specific gas panel used in the preferred embodiment of the invention can write or erase a horizontal stripe the width of the screen (960 pels) and up to sixteen pels high. This permits updating the screen more quickly but at the cost of increased complexity in adapter design. For the particular panel used, panel addressing requires module selection, group selection and specification of the starting pel within a group of modules as will be better understood from the description which follows with reference to FIGS. 7A, 7B and 7C. However, the application program works with absolute X and y coordinates. The translation required is accomplished by the plasma display adapter. The design of the adapter is an example in the hardware/software tradeoff which resulted in a reduced load on the display system microprocessor and achieves increased performance. The architecture chosen supports this hardware/software tradeoff, and the actual circuit implementation preferably uses a Metal-Oxide-Silicon (MOS) technology to achieve high circuit density capabilities.

Figure 5:
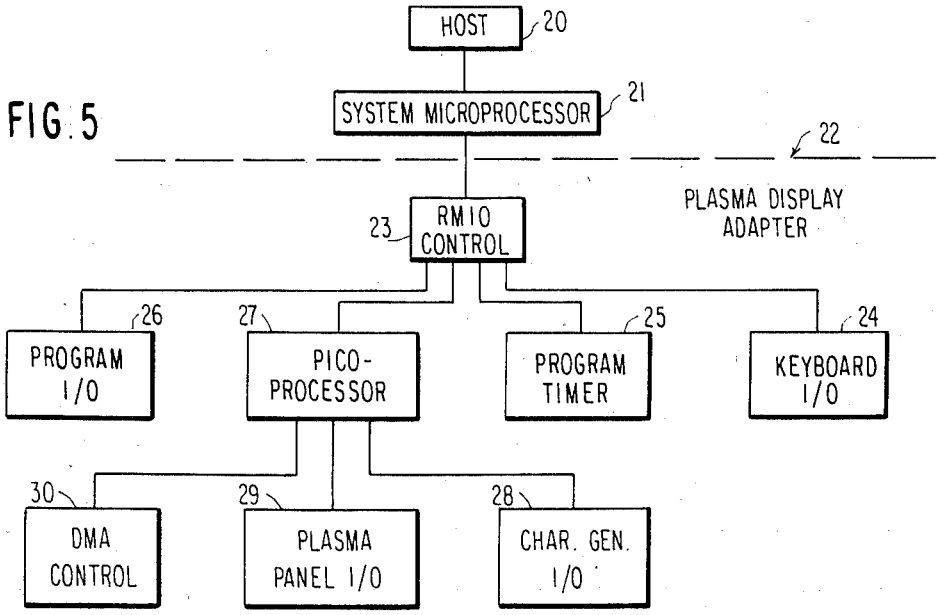
FIG. 5 is a functional block diagram showing the relationship of the plasma display adapter to the system microprocessor and the host.

The interface system is represented by the block diagram of FIG. 5. The host system 20 downloads display data to the display system microprocessor 21 which includes the microprocessor RAM and ROS. system logic and the microprocessor. The microprocessor preferably supports a sixteen bit address bus, a nine bit data bus (eight bits for data and one bit for parity), interrupt and an I/O interface bus. The system is controlled by logic which is driven by the microprocessor and the attached adapter 22. It is function-driven according to demand and generates all memory address and control signals for accessing of memory by the processor during the execution code and by the adapter for transferring data to and from memory. To simplify hardware design and to speed up operation, the adapter 22 can access any part of the microprocessor memory via DMA. The adapter is given access to the buses when it requests them, and upon selection by the system logic, the adapter supplies a sixteen bit address, nine bits of data and a read/write control signal.

There is no unique communication between the system microprocessor 21 and the display panel adapter 22. In the preferred embodiment, the adapter 22 is mapped into a portion of the system microprocessor's 21 register space. Therefore, the processor simply executes a register access instruction. Access of the adapter or a typical register is determined by the address used in the register instruction. This scheme is called register mapped I/O (RMIO) and permits addressing more than one adapter although only one such adapter will be shown and described. The microprocessor has the capability of addressing 64K bytes of register space by using a couple of register indirect instructions. When such an instruction is executed by the processor, a signal is sent to indicate a register operation. As shown in FIG. 16, the system logic 99 senses this, and based on the sixteen bit address, it selects the appropriate adapter 22 by issuing a signal on an I/O select line which is used only by that adapter. Each adapter has 64 register addresses allocated in the system microprocessor's register space for its communication with the system microprocessor 21. The adapter can also initiate communications with the system microprocessor by interrupting at a specified I/O level. Each adapter which has need to store and retrieve information from the system microprocessor memory is interfaced to the system logic via two lines, the DMA request and the DMA select lines. When the adapter has need to access memory, it notifies the system logic via the DMA request line that it wants to access memory. The system logic then, based on a priority scheme, issues a DMA select to the adapter and initiates the control signals to the memory.

The display of data is handled through a unique op code list contained in the system microprocessor memory and fetched by DMA. This list consists of high level commands such as "replace character", "load display parameters" and "load character generator". Each op code is limited to one type of operation and therefore is viewed as a "primitive". However, through the use of "chaining", single op codes may be linked in memory to create "macro" results.

As shown in FIGS. 5 and 16, communication between the adapter and the system microprocessor is handled by the RMIO control 23 and system logic 99. This control communicates with the keyboard I/O logic 24, the programmable timer 25, the programmable I/O port 26, and the picoprocessor 27. The high level interface provided by the adapter is made possible by the picoprocessor 27 which executes picocode from an on-chip ROS 32 shown in FIG. 6. The picoprocessor decodes high-level commands from the system microprocessor and translates them into a sequence of simple commands for the surrounding interface logic which includes the character generator I/O 28, the plasma panel I/O 29 and the DMA control 30. The picoprocessor can also vary the sequence of interface logic commands and adjust parameters used based on the adapter input parameters. An example of this operation is the sequence of logic for replace mode operations described hereinafter.

Figure 6:
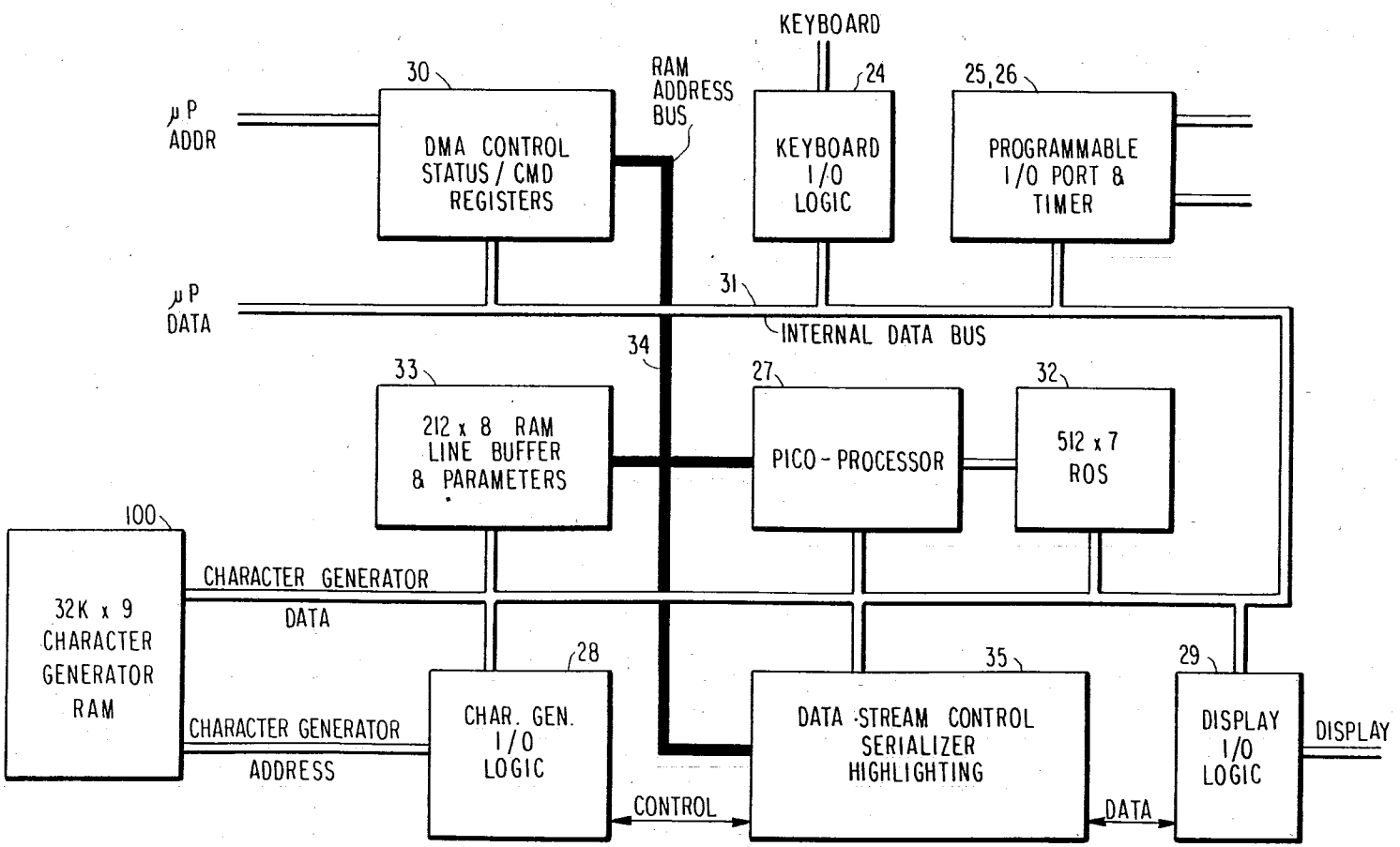
FIG. 6 is a more detailed block diagram showing the organization of the plasma display adapter.

As is best shown in the block diagram of FIG. 6, the picoprocessor 27 is the center of a common bus architecture. All interface logic macros can both send and receive on the bus 31. The picocode for the picoprocessor 27 is contained in ROS 32, and the picoprocessor 27 communicates with an on-chip RAM 33 via the address bus 34 and data bus 31. In addition, separate control lines exist (not shown here) between the picoprocessor 27 and the interface logic macros. These provide sequence signals and indicate data on bus 31 to be loaded by the interface logic macros. The keyboard interface logic 24 performs a simple "data available", "acknowledge" handshake and an eight bit parallel data transfer. Keystroke data is loaded into a display panel adapter RMIO register and a microprocessor interrupt with keystroke complete status is generated by the adapter. Keystroking in particular and RMIO in general are totally asynchronous to DMA and display update activity. The programmable timer 25 is an eight bit timer whose operation is asynchronous with other adapter functions. The programmable I/O port 26 allows the display system microprocessor 21 to sense or control up to sixteen system external devices through eight input and eight output lines. The display panel adapter provides read (for display and verification), write (for initialization) and refresh control for a 32,768 by nine bit character generator 100. This generator may contain up to 2048 different symbols, all accessible for display through different data stream and initialization commands. The adapter supports the panel's unique addressing requirements by translating the binary representation of the display location into an X,Y coordinate driver selection and line selection within the driver. Control line synchronization and two bit data serialization are provided by the display I/O logic 29 and the data stream control serializer 35.

Figure 7A:
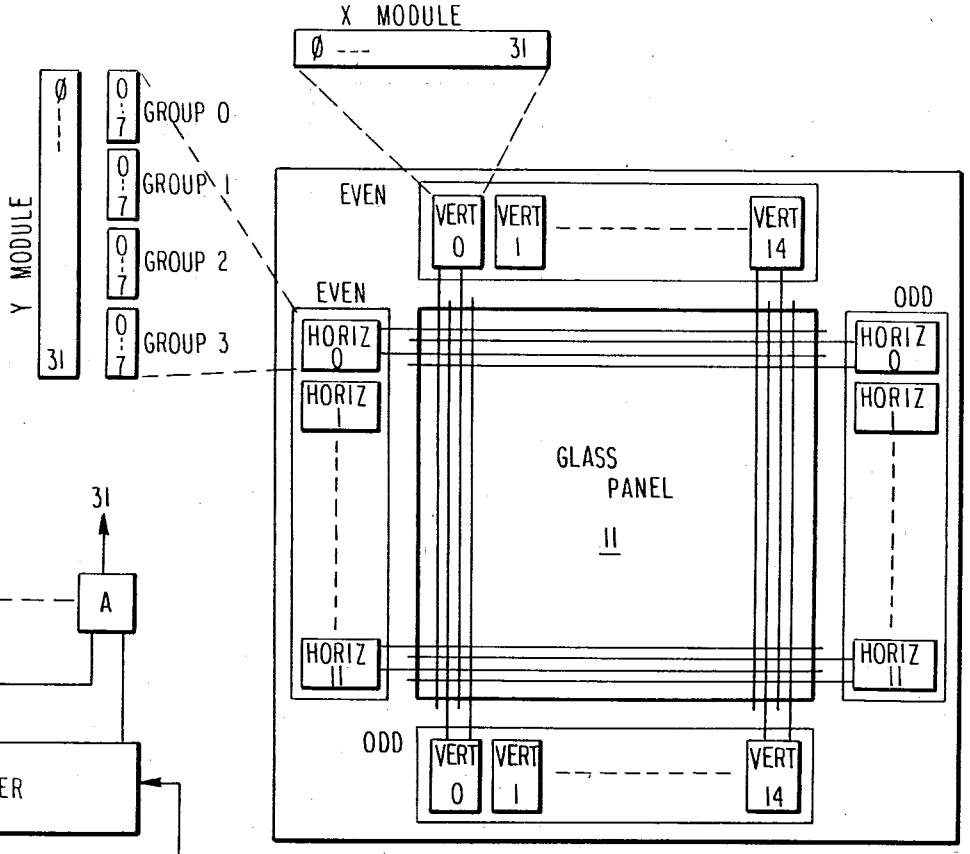
FIGS. 7A, 7B and 7C taken together are a diagrammatic representation of the gas panel showing the organization of the X and Y addressing registers.
Figure 7C:
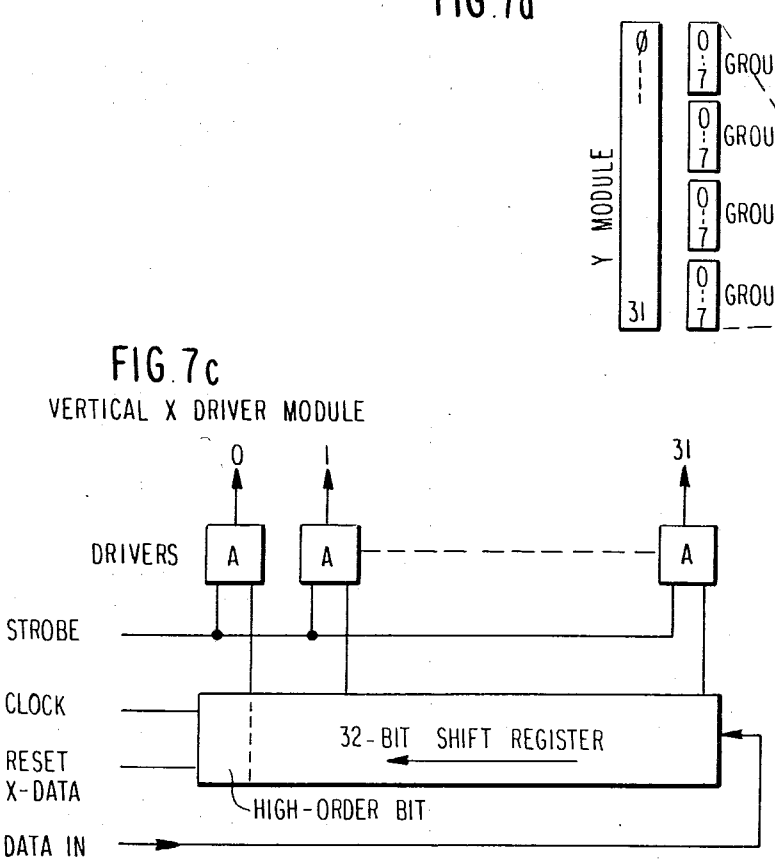
Figure 7B:
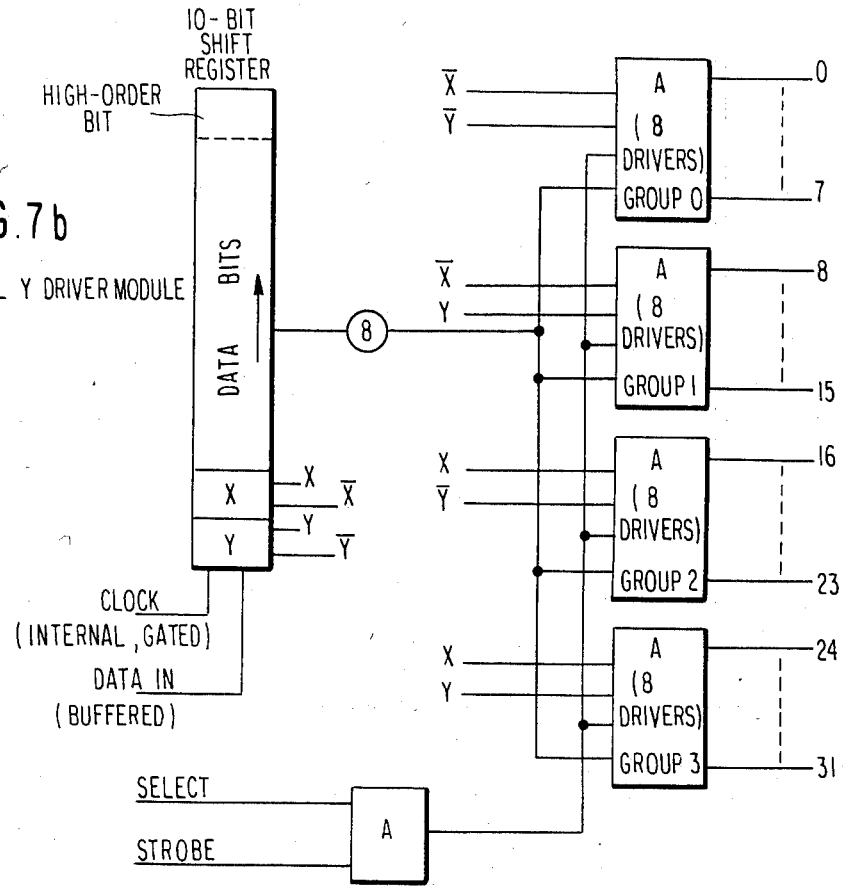
Figure 8A:
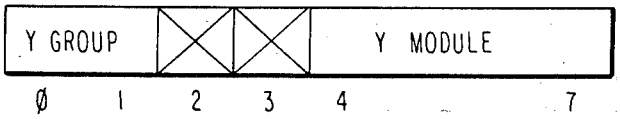
FIGS. 8A, 8B and 8C illustrate X and Y addresses as calculated by the picoprocessor and stored in on-chip RAM.
Figure 8B:
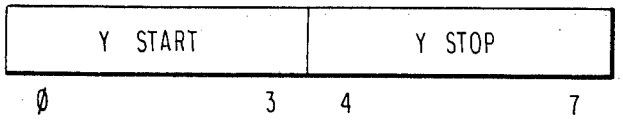
Figure 12:
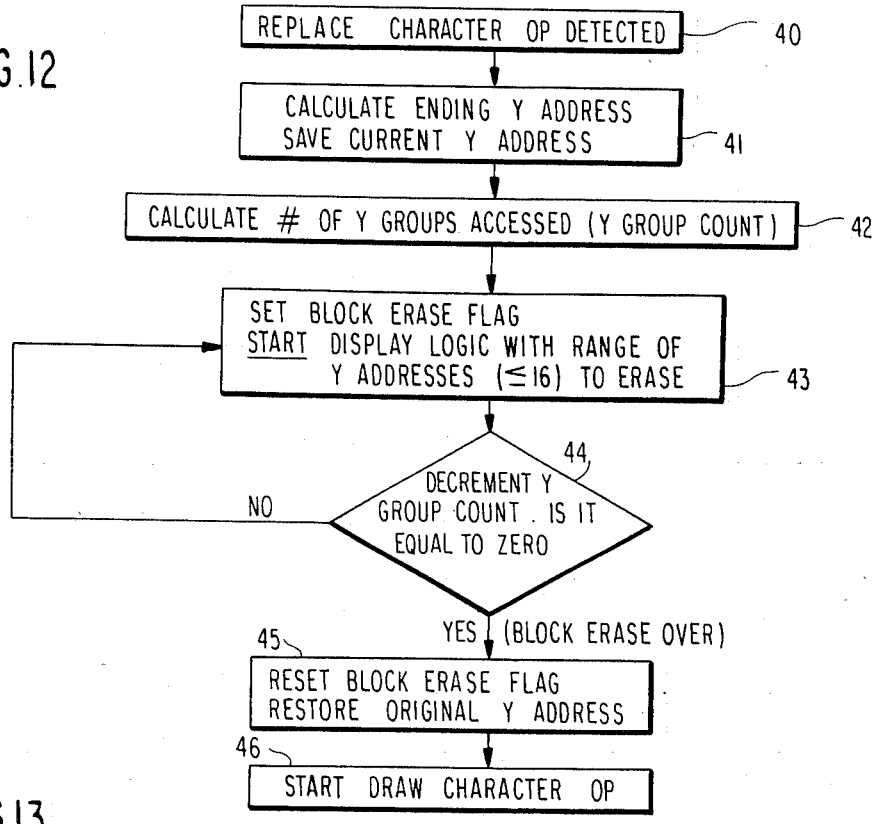
FIG. 12 is a flow diagram of the replace character operation.

As stated, the application program or the local terminal intelligence works with absolute X,Y screen coordinates, but the gas panel used requires module selection, group selection and specification of the starting pel within a group or module as illustrated in FIGS. 7A, 7B, 7C. The first area of translation is the Y address which is specified by the system microprocessor 21 as an absolute coordinate. The Y address is loaded into a register in the picoprocessor 27 where it is shifted and rotated until the Y group/module is assembled as represented by FIG. 8A. This byte is then stored in RAM 33 for later use. The picoprocessor will recalculate this byte only if the Y address changes to a value outside the current group/module ranges. It will be observed from FIGS. 7A and 7B that a pair of even and odd Y modules (32 bits) appear to be 64-bits wide to the adapter and there are four sixteen bit groups within each module pair. To efficiently use this 16-bit group, Y start/stop byte is assembled as shown in FIG. 8B. This specifies on which Y line within the group the write or erase will start and on which line it will stop. For single line operations, these two values will be equal. For block erase operations, the adapter takes advantage of the gas panel's ability to erase multiple Y lines within the same group. First, the picoprocessor determines the Y address range of the block erase by adding the height to the current Y value. Then it performs modulo-16 calculations to determine the number of Y group boundaries crossed as indicated by block 42 in the flow diagram of FIG. 12. If multiple Y groups need to be accessed, then several erase cycles will be required as indicated by blocks 43 and 44 in FIGS. 12. The purpose is to erase as many lines in as few cycles as possible. When multiple accesses are required, the Y group/module byte will be recalculated by the picoprocessor. The following illustrates by way of example a block erase which involves three Y groups.

| | |
|---|---|
| Block Erase Example | |
| Starting Y | = 60 (base 10) |
| Height | = 32 (base 10) |
| First Erase Cycle | |
| Y group/module | = 1 1 X X 0 0 0 0 Module Ø, Group 3 |
| Y start/stop | = 1 1 0 0 1 1 1 1 Start $12_{10}$, Stop $15_{10}$ |
| Second Erase Cycle | |
| Y group/module | = 0 0 X X 0 0 0 1 Module 1, Group Ø |
| Y start/stop | = 0 0 0 0 1 1 1 1 Start Ø, Stop $15_{10}$ |
| Third Erase Cycle | |
| Y group/module | = 0 1 X X 0 0 0 1 Module 1, Group 1 |
| Y start/stop | = 0 0 0 0 1 0 1 1 Start Ø, Stop $11_{10}$ |

X = Don't Care

At the display I/O logic 29, the Y group/module and start/stop data is transmitted by both serial and parallel means. The Y module data is driven from four parallel output pins. The Y group and start/stop data is clocked out serially in twenty significant bits, sixteen for line selection within the group, two for even module group selection, and two for odd module group selection.

Figure 8C:
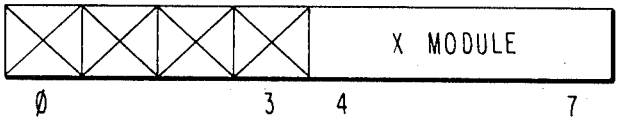
Figure 8C:
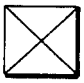

The X module address calculation is identical to that of the Y module. The result is the X module byte as represented by FIG. 8C. This data is driven from the same four parallel outputs as the Y module data. The steering of this data to either X or Y address logic at the gas panel is determined by a fifth interface line controlled by the adapter 22. As is the case with the Y modules, a pair of even and odd X modules (32-bits) appears to the adapter 22 as a 64-bit wide module, as may be appreciated by reference to FIGS. 7A and 7C. The address resolution within the 64-bit X module is provided by padding the display data. This is necessary due to the unique requirements of the interface. If the starting X address specified by the system microprocessor 21 is not exactly divisible by sixty-four (base ten), then a pre-pad of the screen data is necessary. The pre-pad is the number of non-displayable data pels to be shipped serially to the gas panel before valid data begins. It is equal in value to the six least significant X address bits provided to the adapter 22 by system microprocessor 21 and is used to provide proper horizontal alignment of the data. However, the data is clocked out serially two bits at a time, so different boundary conditions will exist throughout the transmission. When highlighting is added on a character basis, this adds to the complexity of the situation. If the character is odd in width, then characters will alternately start on even and odd pel boundaries. This, and the case of starting on an odd X address is handled by steering logic in the data serializer 35. As shown in more detail in FIG. 9, the data is either loaded directly or offset by one pel address into the serializer register 36 by means of steering logic 37. The same logic that controls the steering of data into the data serializer 36 also maintains flags for mixed character boundaries and mixed starting and ending conditions. This handles the following conditions:

Start X Address Odd—only the second pel of the two pel data shift is valid.

Ending X Address Even—only the first pel of the two pel data shift is valid.

Mixed Character Boundary—the first pel belongs to character N; the second to character N=1. This is particularly significant if *different* highlighting is used on each character.

While data is shifting, another counter counts the number of pels transmitted across the interface (modulo-64). For proper horizontal alignment, any X module pair that is accessed must be completey filled with data since these pairs appear to the adapter to be a 64-bit shift register. If valid data runs out before this point, the logic will continue to shift using non-displayable data until the modulo-64 -counter has cycled. This excess data is called post-pad. FIG. 10 illustrates the pre-pad and post-pad with the display data in the 64-bit shift register.

Because the gas panel retains previously written data, a replace mode is used to provide selective, high performance character updates. This permits operations like scrolling, insert and delete. An advantage of this approach is that the display controller does not have to know the screen contents in the update area or specify the erasure of individual pels. The plasma display adapter handles the update operation by performing a high speed erase of all pels within the boundary of the new character(s) before writing the appropriate pels from the character generator. As previously described, the high speed erase utilizes a feature of the gas panel that allows erasure of up to sixteen scan lines in a single erase cycle rather than one scan line per erase cycle. This permits a sixteen pel high character to be erased in one or at most erase cycles as compared to sixteen erase cycles using single scan line erasure techniques. Again, this function is performed by the picoprocessor 27.

When a replace operation is detected, the current Y location is saved in RAM 33. This is necessary because each scan line will be accessed twice, once for the block erase and once for the draw operation. The picoprocessor 27 then adds the character height to the starting Y value to determine the Y dimension of the block erase. With reference now to FIG. 11, the gas panel's single cycle, sixteen line (one group) erase is limited to fixed modulo-16 boundaries. But the range of lines to be erased may exceed sixteen and in most cases will not start on one of the modulo-16 boundaries. The picoprocessor 27 resolves this by performing modulo-16 arithmetic to determine the number of Y groups accessed as indicated by block 42 in the flow diagram of FIG. 12. A group of boundary is crossed as between lines 15 and 16 and lines 31 and 32 in the example illustrated in FIG. 11, so the picoprocessor must determine the proper starting location in the first group and the ending location in the last group. These groups will then be accessed on separate erase cycles until the block erase is complete.

The logic paths in the plasma display adapter are the same for both the erase and the draw portions of the operation. The replace character operation is set forth in the flow diagram of FIG. 12. The first step in the operation is to detect the replace character op code as indicated in block 40. The picoprocessor 27 then calculates the ending Y address by adding the character height to the current Y address and saves the current Y address in RAM 33 as indicated by block 41. The picoprocessor then calculates the number of Y groups accessed in block 42 and sets the block erase flag in block 43. This flag forces all display data (FIG. 10) to "ones" so when the panel 11 erase command is issued, all pels within the range will be erased. Also in block 43, the display logic 29 is started with a range of Y addresses not exceeding sixteen to erase. Then in decision block 44 the picoprocessor determines whether there are remaining Y groups to be accessed. If so, the display logic is again started with a range of Y addresses; otherwise, the block erase is complete in which case the picoprocessor 27 resets the block erase flag and restores the original Y address as indicated in block 45. Then in block 46 the picoprocessor starts the draw operation.

The plasma display adapter makes possible multi-width character display. The nominal width-height ratio for the display of alphanumeric data is $9\times16$ pels. A typical character displayed uses only seven of the nine horizontal pels for information. The other two pels are used for spacing or the creation of a "box" in which the information bits will reside. Because of the finer resolution exhibited by the gas panel, smaller character boxes are possible without sacrificing "readability". Also, as pel densities increase, the number of bits displayed per character must also increase to maintain the original $9\times16$ aspect ratio. This is handled in the adapter by allowing the system microprocessor 21 to specify any box width between four and thirty-one pels for both characters and non-coded information (NCI). In the case of characters, the character generator RAM 100 holds 9 pels of horizontal information. For widths less than nine, this information is truncated to the specified width. For widths greater than nine, the information is padded with additional pels to the right of the character. These pels follow the highlighting of the character box (i.e. for normal highlighting, blank pels are inserted, but for reverse highlighting, pels that are lighted are inserted).

Figure 13:
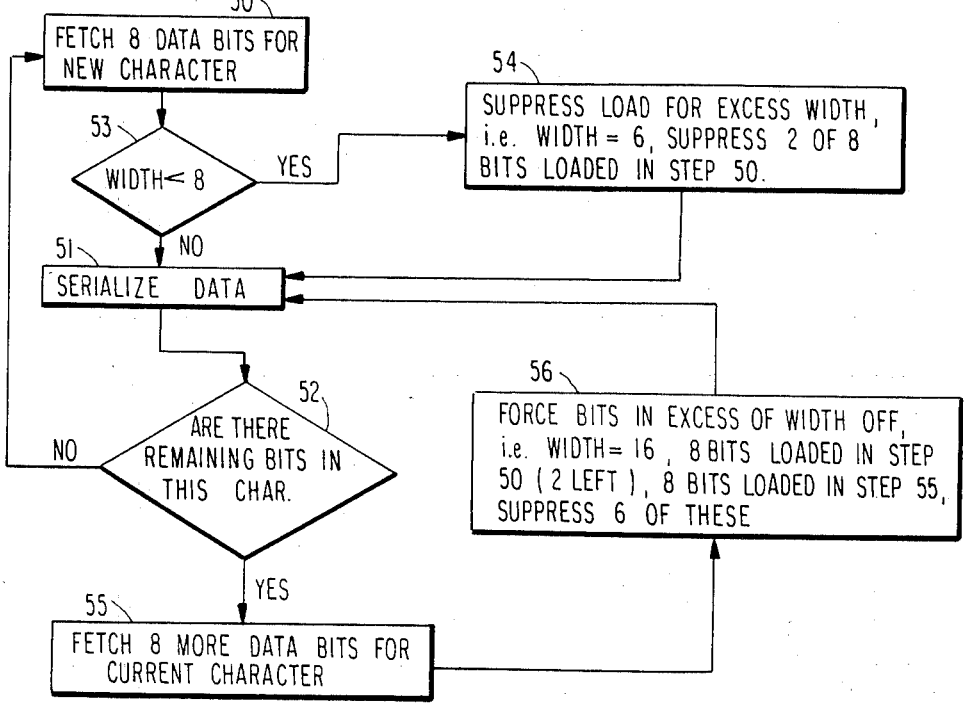
FIG. 13 is a flow diagram of the variable width character feature.

With reference now to FIG. 13, the plasma display adapter fetches parallel data (8 bits) from either the character generator 28 for coded data or from RAM 33 for NCI as indicated in block 50. The data is then serialized in serializer 35 for transmission to the gas panel as indicated in block 51. The variable width feature is implemented by designing the serializer 35 around a byte (eight bit) wide data bus. The logic resolves the five bit width field from the system microprocessor 21 into a two bit modulo-8 count that determines how many times the serializer 35 will iterate. Data is loaded into the serializer eight bits at a time. When the serialization is complete, the two bit count is checked. If it is not zero, then it is decremented, more data is loaded in block 55 and another pass through the serializer begins as indicated by decision block 52. This continues until the count equals zero. Also, portions of the data load may be suppressed if loading the full eight data bits would cause the specified width to be exceeded as indicated by blocks 53 and 54 and by block 56. Widths less than nine pels can be used on the gas panel to provide a compressed character display. Widths greater than nine pels can be used to insert additional inter-character spacing if all nine of the character generator bits are used for display information. The latter case may be used to create an enlarged character display or to maintain the current aspect ratio on higher density displays. It should be noted, however, that to maintain this aspect ratio with widths greater than nine pels, heights greater than sixteen pels must be generated. The plasma display adapter supports heights of one to 255 scan lines. "Pad" scan lines that follow the character by highlighting are automatically inserted beyond scan line sixteen.

In handling a field oriented data stream, the situation can arise where a display update is required within a field but a complete field rewrite is not desired. An example of this is where a character is to be inserted on a line, simply by writing the new character and rewriting the now shifted characters to the right of it. However, in the data stream used in the preferred embodiment of the invention, field qualifiers exist which specify the highlighting, color, character geneator font, intensity and display/non-display of all characters in their field. Some of these can be over-ridden and others cannot. In the case where the individual character attribute specifies a default to the field, these field parameters must be present. The plasma panel 11 provides a unique challenge over prior art CRT's. CRT's provide a sequential raster refresh of the display. As a memory device, the plasma panel can be used in random-access mode. It is in just this mode where the situation described here arises. In order to provide specification of these field parameters without rewriting the entire field, the plasma display adapter can interpret an artificial initialization attribute. With reference to FIG. 14, in the normal processing of a character row, the adapter reads a current data stream character into one of its registers 60 and updates another register 61 if an extended and/or field attribute is detected. Field information detected in this way is normally used for subsequent characters until the next field information is detected. However, the system microprocessor 21 may selectively write this register 61 before starting the adapter 22 on a screen update operation. This means that a character or characters may be inserted in mid-field simply by writing the proper field attributes into the adapter registers. While conventional field attributes use a position on the display, these register based attributes require no such location. In other words, access by the system microprocessor to the adapter registers provides the ability to specify a field attribute outside the data stream. The key to this operation is steering logic 62 that sends the attribute information from register 61 to the highlighting logic 63 for the first character of every row. This will be over-ridden, however, if the first character position on the row contains a field attribute (in this case register 60 is directed to the highlighting logic 63).

There are certain data stream handling requirements that can easily overburden the system microprocessor, particularly with a data stream with both field and character atrributes. The problem becomes more acute with the gas panel display environment because the display adapter cannot automatically handle blinking and underscoring of characters and fields. Therefore, the microcode must be aware of all blink and underscore locations and handle them separately. This could be done with a search through the display buffer, peforming tests along the way to detect the different attributes. But this approach does not have very good performance due to the fetch and test loop required for each character in the buffer. This is compounded with the large screen display panel used because the display buffer can be as large as 10,000 characters (20,000 bytes). Another approach would be for the microcode to build and maintain an attribute position list. This has problems of performance, storage required and complexity associated with it.

This problem is solved by performing the attribute testing in the plasma display adapter 22 by checking the data while it is being loaded into the adapter by DMA. After the system microprocessor 21 requests a character row write, it can read adapter register 101 (FIG. 17), to determine if further screen update is required as, for example, underscore. The microcode can also read back the field characteristics that were active at the end of the row (e.g., non-display) through the field and extended field attribute detect registers 61 in the adapter. This field information will be used on the next row unless the first character of that row is a field attribute. The following attributes and characters are tested for:

Any NULL Characters in the Display Data
Any Blinking Characters in the Display Data
Any underscore Characters in the Display Data
Any Field Attributes in the Display Data
Any Field Intensify Attributes in the Display Data
The Last Field Attribute Detected
The Last Extended Field Attribute Detected The operation of the data management system according to the invention will now be briefly summarized with reference to FIG. 15. In block 70, the system microprocessor 21 creates adapter op codes in system microprocessor RAM, initializes parameters in the adapter and issues the command to start to the adapter 22. The adapter 22 then fetches the op code from the microprocessor RAM by DMA and decodes as indicated in block 71. The adapter 22 next fetches display data and stores it in RAM 33 in block 72. Once the op code and display data have been fetched, the picoprocessor 37 calculates display parameters and initializes the display I/O logic 29 (FIG. 6) as indicated in block 73. Based on these calculations, the line buffer addresses the character generator RAM 100, data is serialized and highlighted in serializer 35 and then displayed as indicated in block 74. Once the data in serializer 35 has been outputted by the display I/O logic 29 and displayed on the plasma panel, the display I/O logic 29 flags completion to the picoprocessor 27 as indicated on block 75. The clean-up performed by picoprocessor 27 returns the adapter 22 to a base state, ready to execute additional op codes. In decision block 76, if a chained op code is being executed, the operation returns to block 71; otherwise, the adapter interrupts the system microprocessor 21 with completion status and the operation stops as indicated in block 77.

We claim:

1. A display management system for at least one plasma gas panel display, said at least one plasma gas panel display having a complex interface requiring the computation of the boundaries of write and erase operations based on commands from an application program and the geometry of said at least one plasma gas panel, said display management system comprising:

host processor means for supplying application program operations, system microprocessor means connected to said host processor means for receiving and storing application program operations downloaded from said host processor means, said system microprocessor means further carrying out decoding and execution of commands in said application program operations downloaded from said host processor means including management of display data, and at least one plasma display adapter means for providing high level control of said interface to said gas panel display, for serialization of character data, and for computing the boundaries of said gas panel write and erase operations.

2. In a plasma gas panel display system of the type comprising a host processor for supplying application program operations to a system microprocessor, said system microprocessor creating op codes and initializing display parameters and storing said op codes and display parameters in microprocessor first memory means, and at least one plasma gas panel display having a complex interface requiring the computation of boundaries of write and erase operations, the improvement comprising at least one plasma display adapter having a common internal bus architecture and comprising:

logic means connected to said common internal bus for computing the boundaries of plasma gas panel write and erase operations, second memory means connected to said common internal bus for storing picocode for controlling said logic means, said second memory means further storing results of calculations performed by said logic means, control means connected to said common internal bus for fetching op codes and display parameters from said first memory means by direct memory access and for storing said op codes and display parameters in said second memory means, and character generator and serializer means connected to said common internal bus for serializing character data for transmission as a formatted data stream to said plasma gas panel display according to the boundaries calculated by said logic means.

3. The improvement as recited in claim 2 wherein said system microprocessor means generates a field attribute in response to application program operations and further comprising register means accessible by said system microprocessor for storing a field attribute for insertion in the data stream formatted by said character generator and serializer means.

4. The improvement as recited in claim 2 further comprising attribute detect and register means for detecting and storing a field attribute in said data stream, said field attribute being used for the next display row unless the first character of that row is a field attribute.

5. A display management system for at least one plasma gas panel display, said at least one plasma gas panel display having an interface requiring the translation of display position addresses from absolute cartesian coordinates to panel addresses, said display management system comprising:

host processor means for supplying application program operations, system microprocessor means connected to said host processor means for receiving and storing application program operations downloaded from said host processor means, said system microprocessor means carrying out decoding and execution of commands from said host processor means including management of display data, and at least one plasma display adapter for providing high level control of said interface to said gas panel display, for serialization of character data, and for translation of display position addresses from absolute cartesian coordinates specified by said system microprocessor means to panel addresses.

6. The display management system recited in claim 1 including shift registers corresponding to an X cartesian coordinate address on said panel, said shift registers being loaded with pre-pad and post-pad non-display data to properly align said data to be displayed on said plasma gas panel.

7. A display management method for at least one plasma gas panel display, said at least one plasma gas panel display having a complex interface requiring the translation of display position addresses from absolute cartesian coordinates to panel addresses, said display management method comprising the steps of supplying application program operations from a host processor to a system microprocessor by downloading said application program operations from said host processor to microprocessor memory means within said system microprocessor, creating op codes and initializing display parameters using said system microprocessor and storing said op codes and display parameters in said microprocessor memory means, fetching said op codes and display parameters from said microprocessor memory means by direct memory access and decoding said op codes and storing said display parameters in memory means, and translating display position addresses from absolute cartesian coordinates specified by said display parameters initialized by said system microprocessor to panel addresses.

8. The display management method recited in claim 7 further comprising the steps of sending a start signal after creating op codes and initializing display parameters, and interrupting said system microprocessor to signal completion of a display operation.

9. The display management method recited in claim 7 further comprising the step of serializing character data for transmission to said plasma gas panel display.

* * * * *